US007412937B2

(12) United States Patent
Stevens et al.

(10) Patent No.: US 7,412,937 B2
(45) Date of Patent: Aug. 19, 2008

(54) THREE DIMENSIONAL CAMOUFLAGE FABRIC AND METHOD OF MAKING SAME

(76) Inventors: John E. Stevens, 1455 Glen Ave., Muskegon, MI (US) 49441; Jay M. Bylsma, 17150 Lake View Dr., Holland, MI (US) 49424; Paul E. Takken, 24 Ida Red Dr., Sparta, MI (US) 49424

( * ) Notice: Subject to any disclaimer, the term of this patent is extended or adjusted under 35 U.S.C. 154(b) by 10 days.

(21) Appl. No.: 11/526,356

(22) Filed: Sep. 25, 2006

(65) Prior Publication Data

US 2007/0084391 A1 Apr. 19, 2007

Related U.S. Application Data

(60) Provisional application No. 60/720,312, filed on Sep. 23, 2005.

(51) Int. Cl.
*D05B 35/06* (2006.01)
*D05B 3/12* (2006.01)

(52) U.S. Cl. ..... 112/475.08; 112/412

(58) Field of Classification Search ..... 112/475.01, 112/475.08, 475.09, 470.33, 152, 122, 409, 112/412, 429, 432; 428/17, 102
See application file for complete search history.

(56) References Cited

U.S. PATENT DOCUMENTS

| | | | | |
|---|---|---|---|---|
| 5,486,385 | A * | 1/1996 | Bylund et al. | 428/17 |
| 5,695,835 | A * | 12/1997 | Weber et al. | 428/17 |
| D393,950 | S * | 5/1998 | Lockhart | D5/64 |
| 6,499,141 | B1 * | 12/2002 | Egnew | 2/69 |
| 6,787,212 | B2 * | 9/2004 | Strength et al. | 428/102 |
| 6,910,223 | B2 * | 6/2005 | Egnew | 2/69 |

* cited by examiner

*Primary Examiner*—Ismael Izaguirre
(74) *Attorney, Agent, or Firm*—Jonathan A. Bay

(57) ABSTRACT

A three-dimensional camouflage fabric is produced in a multi-head quilting machine by sewing a multiplicity of transversely spaced, elongated strips of relatively narrow fabric on a relatively wide web of a substrate fabric along laterally spaced lines of attachment positioned between the side edges of the strips. The strips are attached to the substrate in a longitudinal wrinkled condition, giving the strips a three-dimensional contour. The side edges of the strips are formed in an irregular pattern, with edge patterns of adjacent strips being different. The edges of the strips desirably overlap so as to enhance the three-dimensional appearance. The strips can be wrinkled by feeding the strips at a faster rate than the substrate. This can be achieved by a spring feeding mechanism or by sewing the strips at an inclined angle to the substrate.

20 Claims, 9 Drawing Sheets

THREE DIMENSIONAL CAMOUFLAGE FABRIC AND METHOD OF MAKING SAME

CROSS-REFERENCE TO RELATED APPLICATIONS

This application is based on and claims the benefit of the filing date of Applicant's U.S. Provisional Application No. 60/720,312, filed Sep. 23, 2005, the disclosure of which is incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to a three-dimensional fabric that is especially useful in the manufacture of camouflage garments. In particular, the invention relates to a method of manufacturing a composite camouflage material, wherein strips of fabric having irregular edges and having a desired appearance, such as the color of leaves in their various seasons or other patterns intended to represent foliage, are fastened to a substrate formed of a woven textile or other pliable sheet material along plural spaced lines of attachment in such a manner as to cause the attached leafy shaped material to project away from the plane of the substrate and give a three-dimensional, high definition, optical impression of the depth of natural foliage. Such material is used to create camouflage garments or other products.

2. Description of Related Art

Camouflage garments worn by hunters, warriors and armed forces personnel for purposes of concealment most likely predate written history. In the more recent past, a variety of garments have been manufactured in an attempt to impart a three-dimensional forest appearance to the surfaces of a garment. One method of manufacture utilizes multiple layers of strips of material to produce a garment known in the art as a "Ghillie Suit." A problem with the Ghillie Suit, however, is that they are heavy, cumbersome and expensive. Another method of manufacture utilizes material which is photo-imprinted with naturalistic forest scenes. A problem with photo-imprinted garments is that they do not provide any three-dimensional depth and they do not conceal the silhouette of the garment or its wearer.

Another type of three-dimensional garment is produced by first stitching a layer of camouflage material onto an underlying mesh fabric or other substrate with parallel spaced rows of stitches. The camouflage layer is then cut into a leafy shape by cutting the fabric in an irregular pattern between the rows of stitches. Although this method of fabric manufacturing provides something of a three-dimensional effect, a problem with this construction is that the resulting outer "leafy" layer tends to lay flat against the substrate even though lobes are cut in the fabric, unless and until the fabric is bent around body parts when the garment is worn. Efforts have been made to improve these types of two layer garments by heating and shrinking the outer material after it has been attached to the substrate material , typically by applying hot air or infrared radiation to the outer surface of the camouflage material. One problem with this process is that it cannot be used where the substrate is manufactured from typical waterproof material or scent absorbing material, which has a melting point significantly less than the temperature applied to the outer layer.

Another method of manufacture involves die cutting strips of camouflage, coating the strips with urethane to prevent fraying, and then folding the strips to produce overlapping layers of folded material and then sewing the folds down on a garment. One problem with this construction is that the folds of outer material create a rustling noise when a person moves, thereby negating stealth. The folded layers also use quite a bit more material than non-folded layers.

SUMMARY OF THE INVENTION

These and other problems of the prior art are overcome with the present invention by a lightweight, inexpensive camouflage material that provides for effective representation of natural surroundings with three-dimensional depth that is to a significant degree visually indistinguishable from natural surroundings.

The camouflage material of the present invention is formed by a process that can be described as a shirring process. An elongated web of camouflage fabric, die cut or laser cut longitudinally into a plurality of elongated strips having irregular side edges, is attached to a substrate material along parallel spaced lines of attachment by sewing the strips to the substrate. The strips are mounted closely together such that the side edges of adjacent strips overlap, thereby interfering with each other and causing the edges to project outwardly. The strips also are sewn to the substrate by a sewing process that causes the strips of material to be deformed in a plane angular to the plane of the substrate. The present invention provides a process for manufacturing a three-dimensional fabric from which garments or other products can be made, as opposed to a process wherein individual strips or layers are affixed one at a time to an assembled or sub-assembled garment.

DETAILED DESCRIPTION OF THE INVENTION

Figure 1:
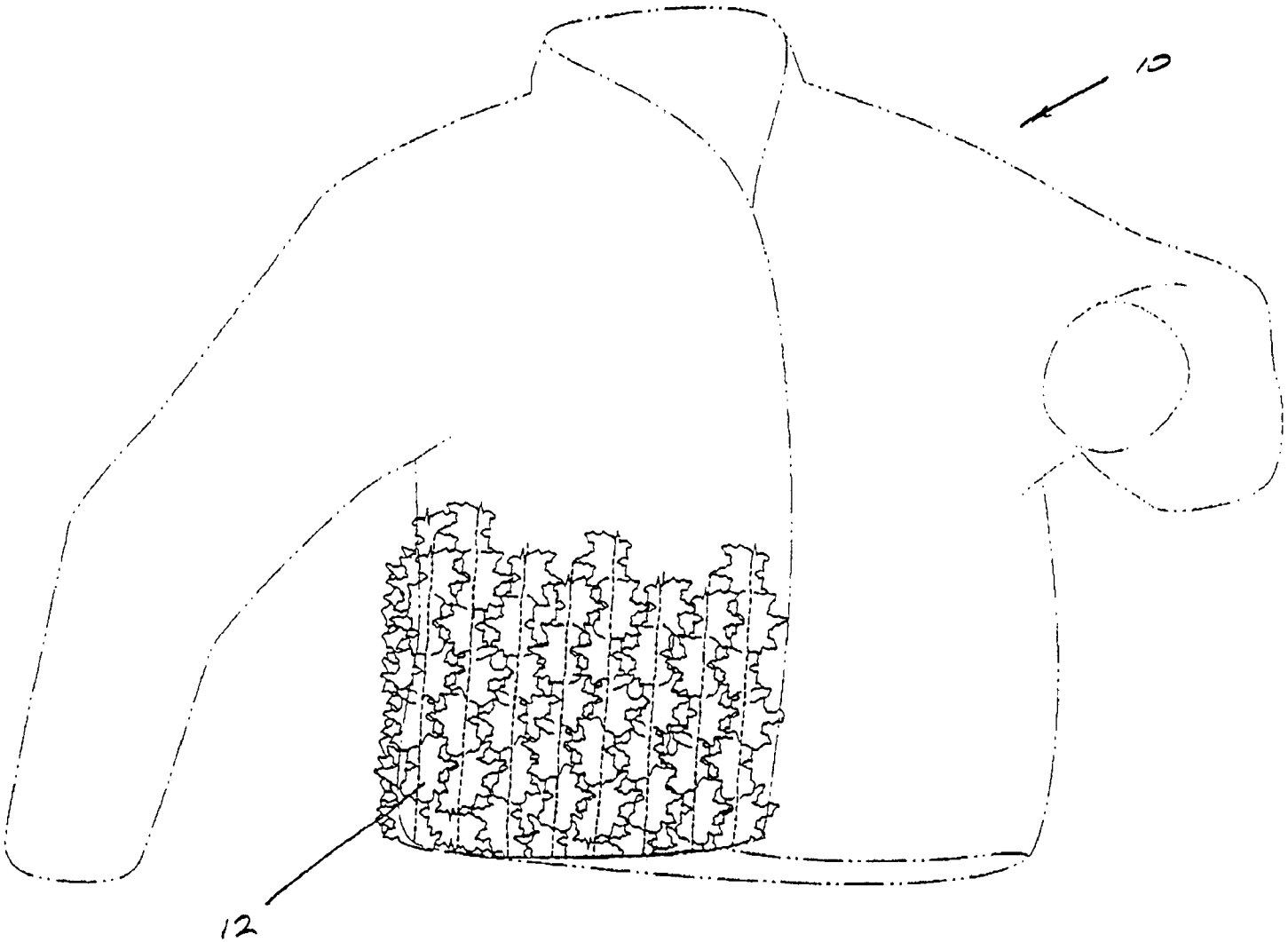
FIG. 1 is a pictorial view of a garment employing the camouflage fabric of the present invention.

Referring now to the drawings, a camouflage garment 10 formed of camouflage material 12 is shown in FIG. 1. Camouflage garment 10 is shown as a jacket for illustrative purposes but could be any type of camouflage garment. It is also contemplated that the three dimensional material of the present invention can be used for other purposes where a three dimensional appearance is desired.

Figure 2:
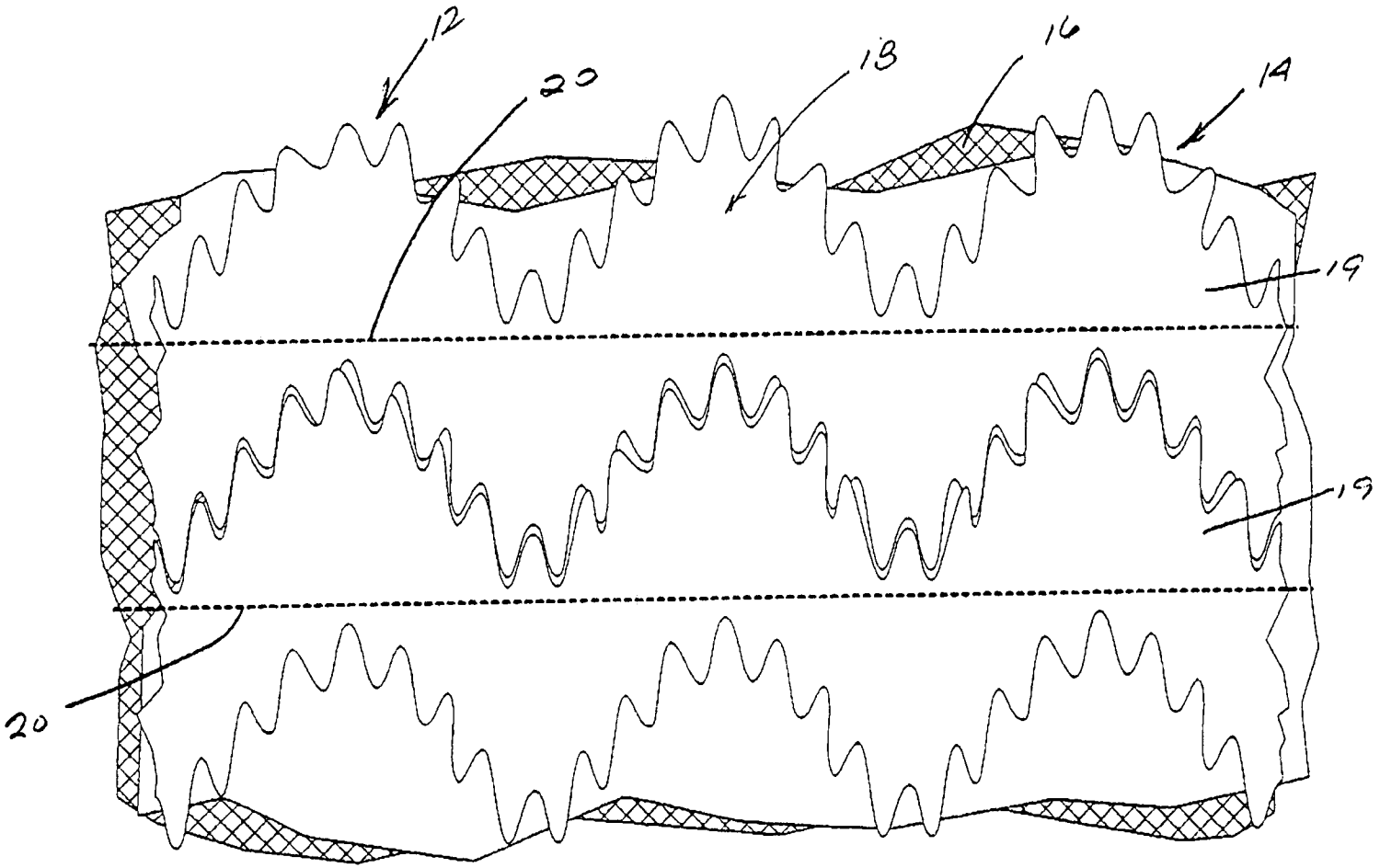
Fig. 2 (Prior Art)
FIG. 2 is a fragmentary plan view of a known type of camouflage fabric.

Camouflage garments, as such, are known. One type of known fabric for use in camouflage garments is shown in FIG. 2. Camouflage material 14 in FIG. 2 comprises a mesh substrate 16 and an outer layer 18 of camouflage fabric sewn by spaced parallel rows of stitches 20 that form lines of attachment between the outer layer and substrate. As stated above, in conventional construction, an outer layer sheet is first sewn to the substrate and then the outer layer sheet is transformed into parallel strips 19 by cutting the attached camouflage fabric into irregular shapes or lobes between the rows of stitches, using a die, hot wire, or hot air cutting tool. The camouflage material formed in this manner tends to lie flat and not have a desirable three-dimensional contour.

In the camouflage material of the present invention, the camouflage strips are first formed and are then sewn to the substrate in parallel rows. Moreover, the irregular side edges of the strips are not configured to match with the side edges of adjacent strips, so the side edges are randomly oriented with respect to adjacent side edges, with at least some portions of the side edges of adjacent strips overlapping. This prevents the side edges from lying flat in the manner shown in FIG. 2.

The manner in which the camouflage strips are attached to the substrate also produces a realistic three-dimensional contour to the camouflage material. In the preferred practice of the invention, the strips of camouflage fabric are provided in rolls in a continuous web and are sewn in a continuous process to the underlying substrate with a sewing machine, preferably a quilting machine, which can attach multiple strips simultaneously to a substrate.

In one aspect of the invention, the camouflage fabric is fed into the sewing machine faster than the underlying substrate, thus giving the camouflage fabric a wrinkled contour while substantially avoiding producing overlapping folds or layers of material that are sewn together. This prevents the fabric from lying flat on the substrate and produces a desirable three-dimensional outer contour to the material. This outer contour can be produced in a number of ways. The methods described herein have been found to be effective.

Figure 3:
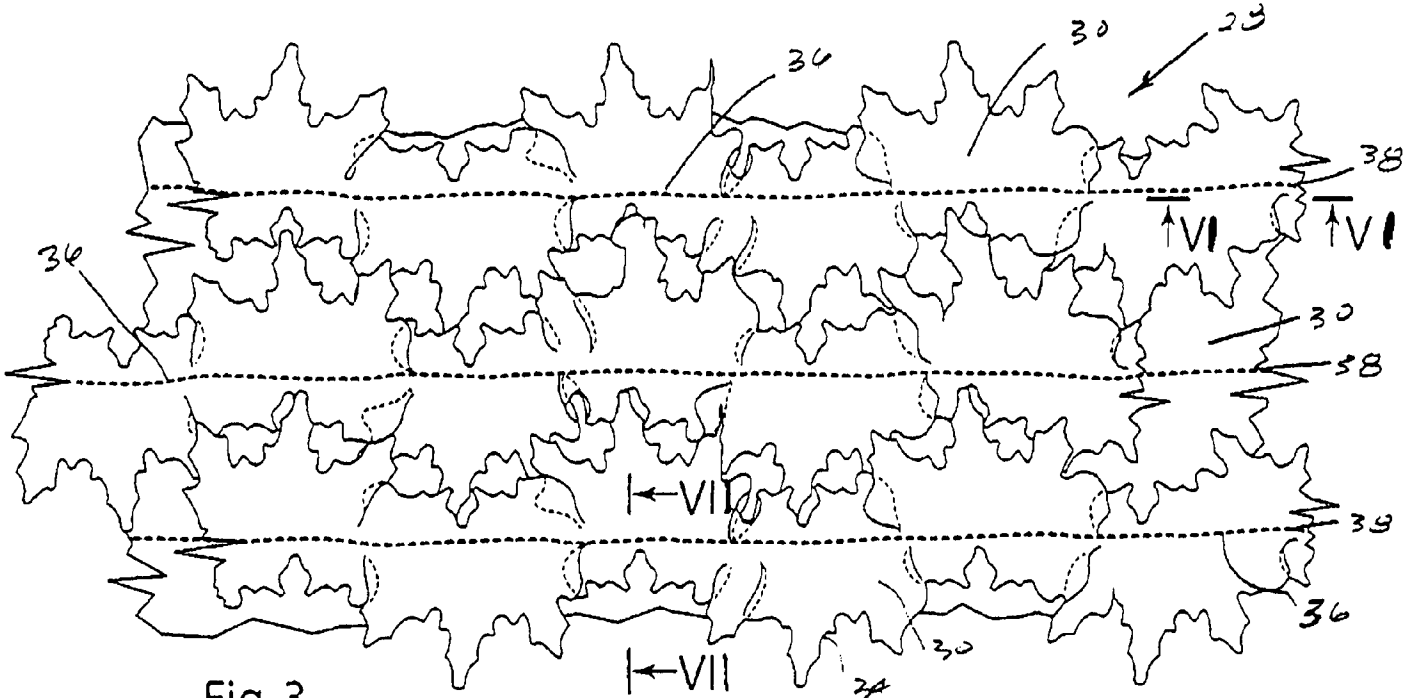
FIG. 3 is a plan view of the camouflage fabric of the present invention.
Figure 4:
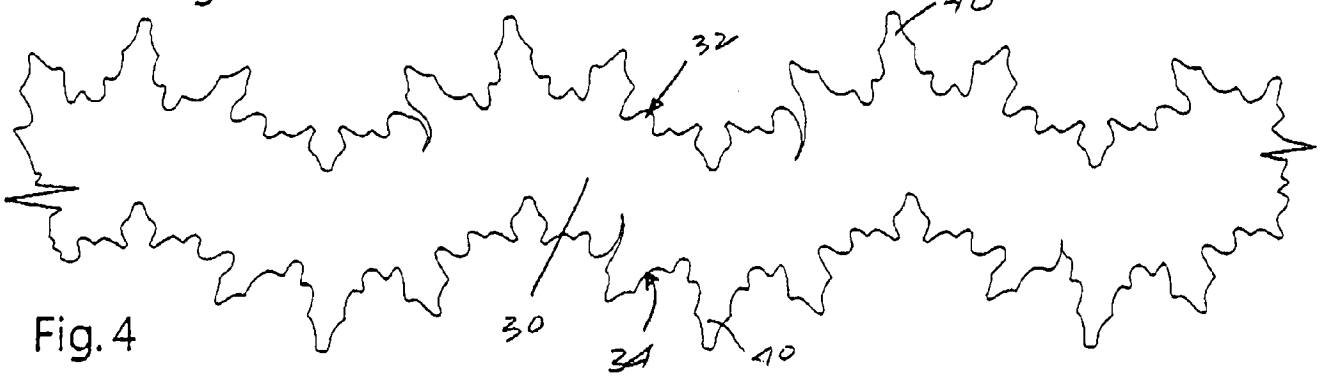
FIG. 4 is a plan view of a segment of one strip of camouflage material of the present invention.
Figure 5:
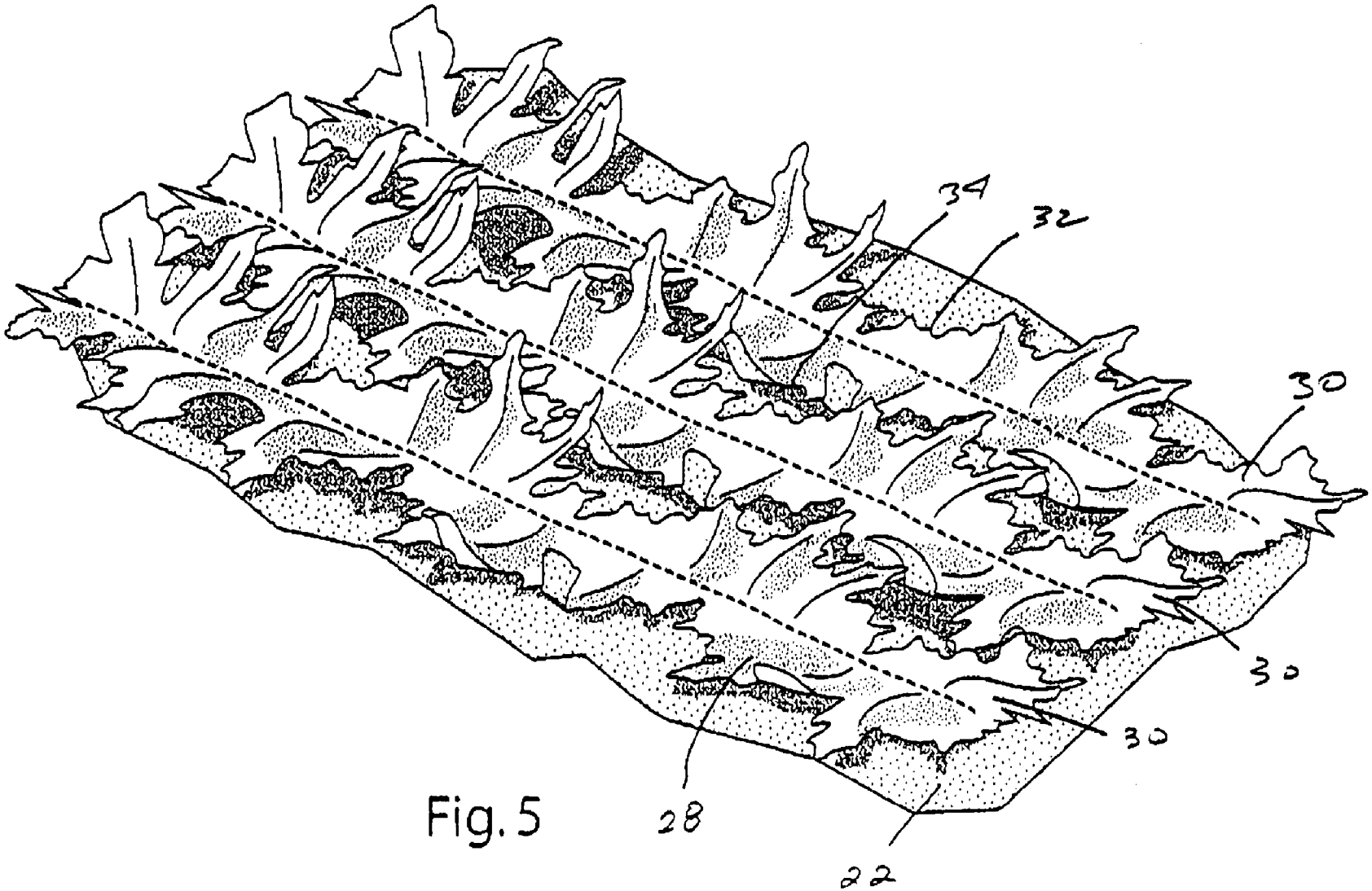
FIG. 5 is a perspective view of a section of camouflage material of the present invention.
Figure 6:
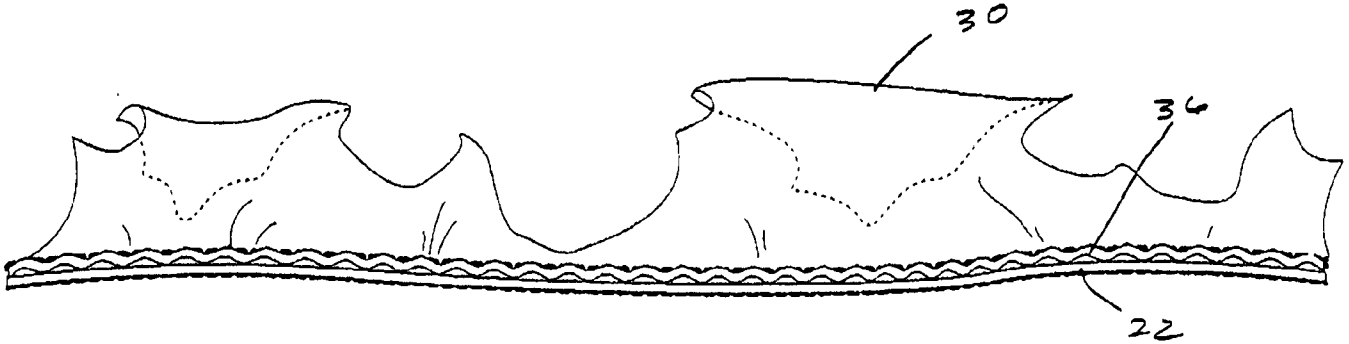
FIG. 6 is a sectional view taken along lines VI-VI of FIG. 3.
Figure 7:
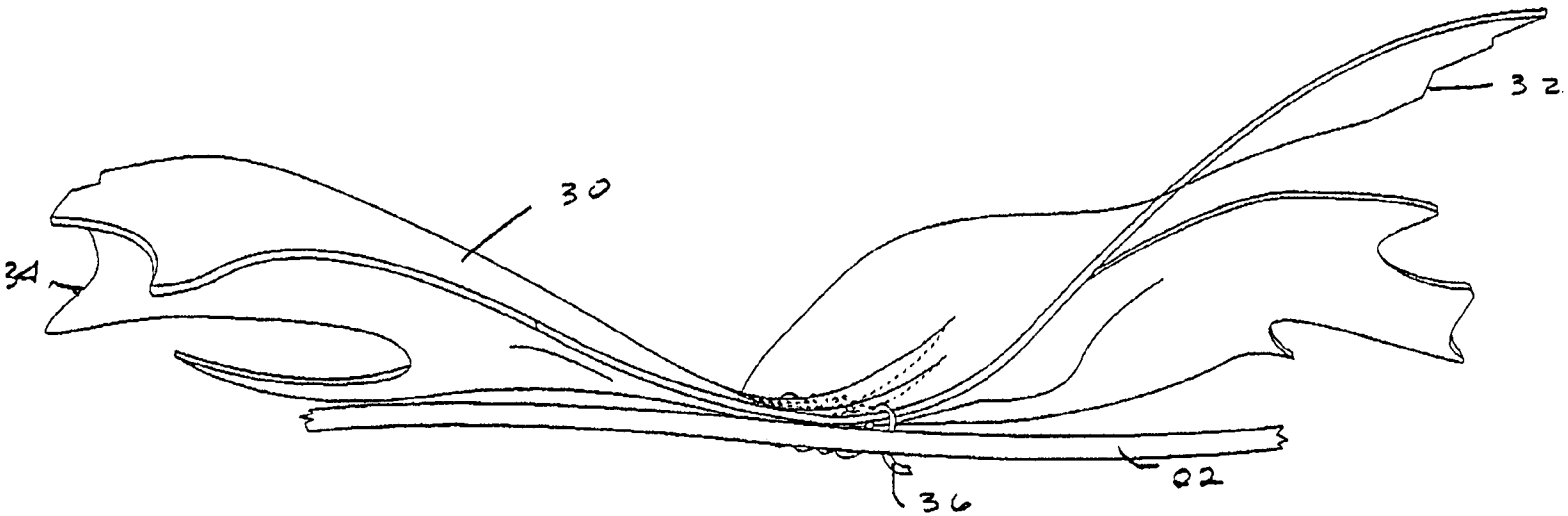
FIG. 7 is a sectional view taken along lines VII-VII of FIG. 3.

Camouflage material 12 constructed in accordance with the present invention is shown in more detail in FIGS. 3-5. Camouflage material 12 comprises a substrate material 22, which can be any desired sheet material, including a woven or non-woven fabric or mesh material and can include a scent blocking material. Substrate 22 is provided in wide rolls and is fed continuously through sewing apparatus 26 of the present invention, which can be a conventional quilting machine, in order to produce the camouflage material 12. A fabric or textile substrate imprinted with the same pattern as the outer layer is one of the preferred substrates.

Camouflage material 12 also includes an outer layer 28, which comprises a plurality of spaced continuous sheet material strips 30 of camouflage fabric having irregular side edges 32 and 34. The term "irregular side edges" is intended to mean non-linear side edges of any particular desired configuration, such as a configuration simulating the appearance of leaves or foliage. The term "irregular side edges" also is intended to include other convoluted shapes, even though they may comprise repeating patterns of known geometric shapes. Desirably, the outer strips are formed of a thermoplastic polyester pongee fabric imprinted with a desired design or pattern, typically a pattern simulating leaves or foliage.

Desirably, the strips 30 of camouflage fabric are produced by laser or die cutting a wide roll of camouflage fabric in a longitudinal or lengthwise direction, so as to produce a series of relatively narrow strips of material, which are mounted on separate rolls. These rolls are then spaced transversely across the width of the substrate and simultaneously sewn to the substrate in a quilting machine or the like in a continuous process to produce a roll of camouflage fabric.

The strips 30 of outer material are attached to the substrate 22 by means of parallel rows of stitching 36 at lines of attachment 38 positioned approximately halfway between the side edges 32 and 34 of the individual strips.

An important difference between the outer layer 28 of the present invention and the outer layer 18 of the camouflage material of FIG. 2 is that the outer material is provided in pre-formed strips to the quilting machine, and the side edges of adjacent strips are not positioned so that the side edges of adjacent strips mate or match as they are attached to the substrate. Thus, the side edges are irregular, in that lobes 40 (outwardly extending portions) on one strip may interfere with lobes 40' on an adjacent strip and overlap or interfere with such strips. Likewise, certain areas of the strips may be somewhat separated from adjacent strips at particular locations. The overlapping and interference of adjacent strips with each other tends to cause the lobes of adjacent strips to be deformed or deflect away from the planar surface of the substrate.

Desirably, the side edges of adjacent strips overlap substantially so the side edges interfere with and deflect each other outwardly.

In an illustrative embodiment of the present invention, the webs of individual strips are approximately five and three-quarters inches wide (the distance between the most outwardly projecting lobes), while the strips are spaced apart on about three inch centers (the distance between the stitches 36 along lines of attachment at approximately the middle of adjacent strips). The overlapping strips enhance the three dimensional effect. The strips can overlap substantially but desirably do not overlap so much that the edge of one strip extends past the line of attachment of the adjacent strip. If this occurs, the side edges of one strip can be stitched to the substrate by the stitching of the adjacent strip. If it is desired to mount the strips closer together, the problem of overlap can be avoided by conducting the sewing operation upside down, so that the lobes hang down and are not likely to be sewn to the substrate in by an adjacent line of stitching.

The three dimensional appearance of the outer layer of camouflage fabric 28 is also enhanced by the manner in which the camouflage fabric is sewn to the substrate. In accordance with the present invention, the camouflage strips are sewn to the substrate in a manner that causes the strips to be slightly wrinkled in comparison with the substrate. This can be accomplished, in effect, by feeding the outer material into the sewing apparatus faster than the substrate, such that the outer layer material becomes slightly wrinkled or bunched when it is sewn to the substrate. This process is sometimes referred to as shirring. The sewing process of the present invention is different from a sewing process that produces multiple layers of fabric by folding one layer on top of the next layer and then stitching the two layers together. In the process of the present invention, the upper layer is wrinkled or convoluted in the manner shown illustratively in FIGS. 12 and 13 but does not comprise folded layers that are sewn together. The somewhat wrinkled configuration of the outer layer causes three dimensional deformation of the outer layer without the excessive use of material involved in a folded an sewn outer layer.

Two preferred methods for achieving the wrinkled or shirred effect of the present invention are shown in FIGS. 8-10 and FIGS. 11 and 12.

Figure 8:
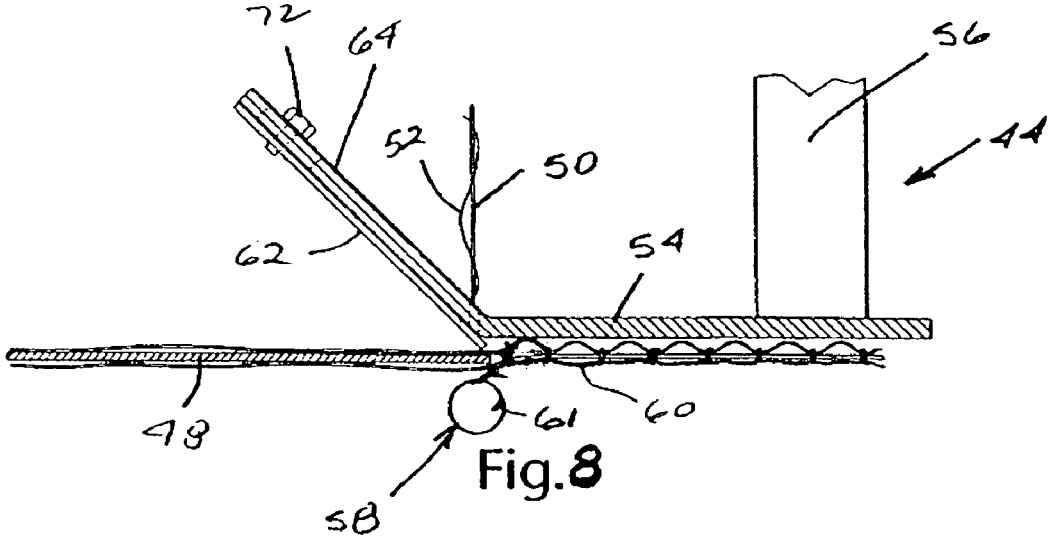
FIG. 8 is a sectional view taken along lines VIII-VIII of FIG. 10, showing the presser foot in raised position.
Figure 9:
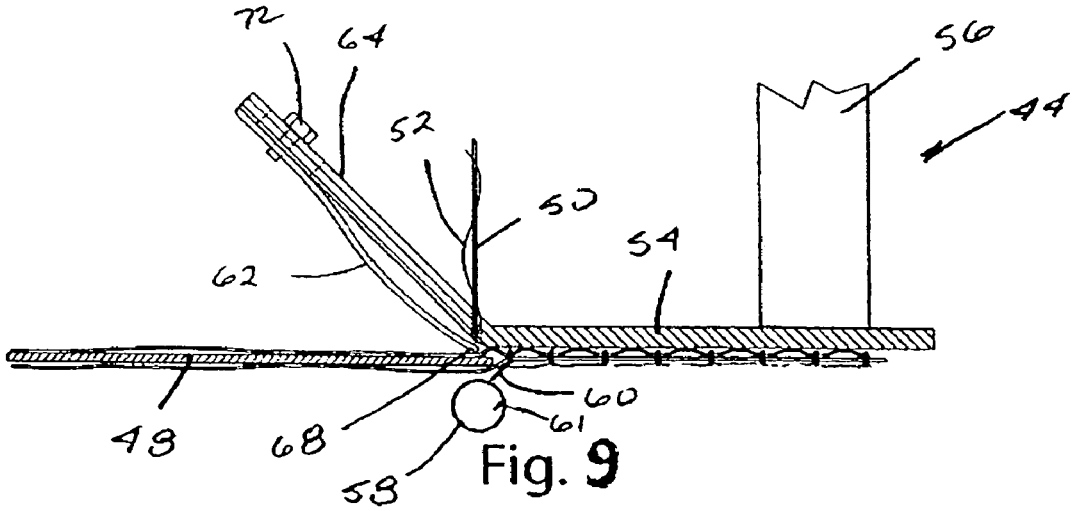
FIG. 9 is a sectional side elevational view as in FIG. 8, showing the presser foot in a lowered position.

Referring first to FIGS. 8 and 9, the substrate fabric 22 and outer layer of camouflage fabric 28 are drawn through the sewing heads 44 (up to seventeen or more sewing heads being positioned across the width of the quilting machine) by drive rollers. The layers of material are separated by a plate 48 immediately upstream of the sewing head 44. A needle 50 reciprocates vertically through the two layers of material and pulls a loop of thread 52 through the material as it reciprocates. A presser foot 54 is mounted for vertical reciprocation by means of an actuator arm 56 at the position of the needle and downstream therefrom. The presser foot clamps the material together and holds it in position while the needle reciprocates through the material in the sewing operation. A conventional bobbin 58 mounted below the presser foot contains a second spool of lower thread 60 A conventional shuttle hook 61 engages a loop in upper thread 52 as the needle extends through the material and causes lower thread 60 to be threaded through the loop on the underside of the material. This is a conventional lock stitch sewing method that his well known and does not form part of the present invention.

The camouflage material can be fed through the sewing machine by means of conventional feed dogs that engage the material and move the material through the machine.

Figure 10:
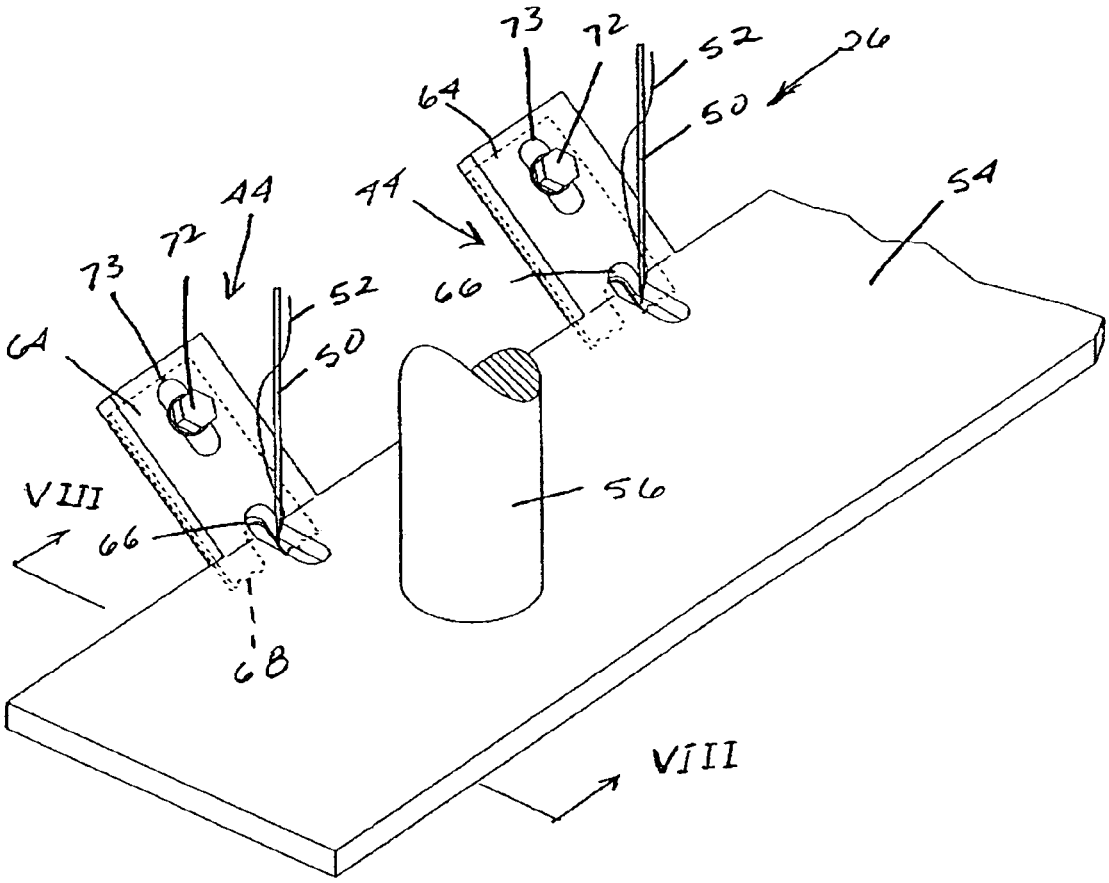
FIG. 10 is a fragmentary perspective view showing a first embodiment of a sewing machine of the present invention.

In order to cause the upper (outer) layer of material to be fed through the machine at the sewing head at a faster rate of speed than the lower material, the sewing head 44 of FIGS. 8-10 can include a spring strip 62 mounted on an angle bracket or presser foot extension 64 that extends at an inclined angle upwardly and away from an upstream edge of the presser foot. A slot 66 in the presser foot and angle bracket and spring strip permits the needle to be reciprocated through the angle bracket and spring strip in order to insert the thread through the fabric.

As shown in FIGS. 8 and 9, when the presser foot is in its raised position (FIG. 8), the lower end 68 of the spring extends slightly below the presser foot. An upper end 70 of the spring is attached by a bolt 72 or the like in a slot 73 in an upper portion of the angle bracket. The slot permits adjustment of the position of the spring. When the presser foot is lowered to clamp the material during the stitching process, the outwardly projecting sharp lower end 68 of the spring strip first engages the outer layer of fabric. Then as the presser foot continues to press downwardly, the spring action of the spring strip, coming in contact with the upper layer of material and then with the plate separating the upper and lower layers of material, forces or sweeps more material of the top layer into the sewing process than the lower layer, which is drawn into the sewing needles by the feeding action of the machine. This action thereby produces the desired shirring effect and produces a three dimensional effect or wrinkle in the upper fabric.

Figure 11:
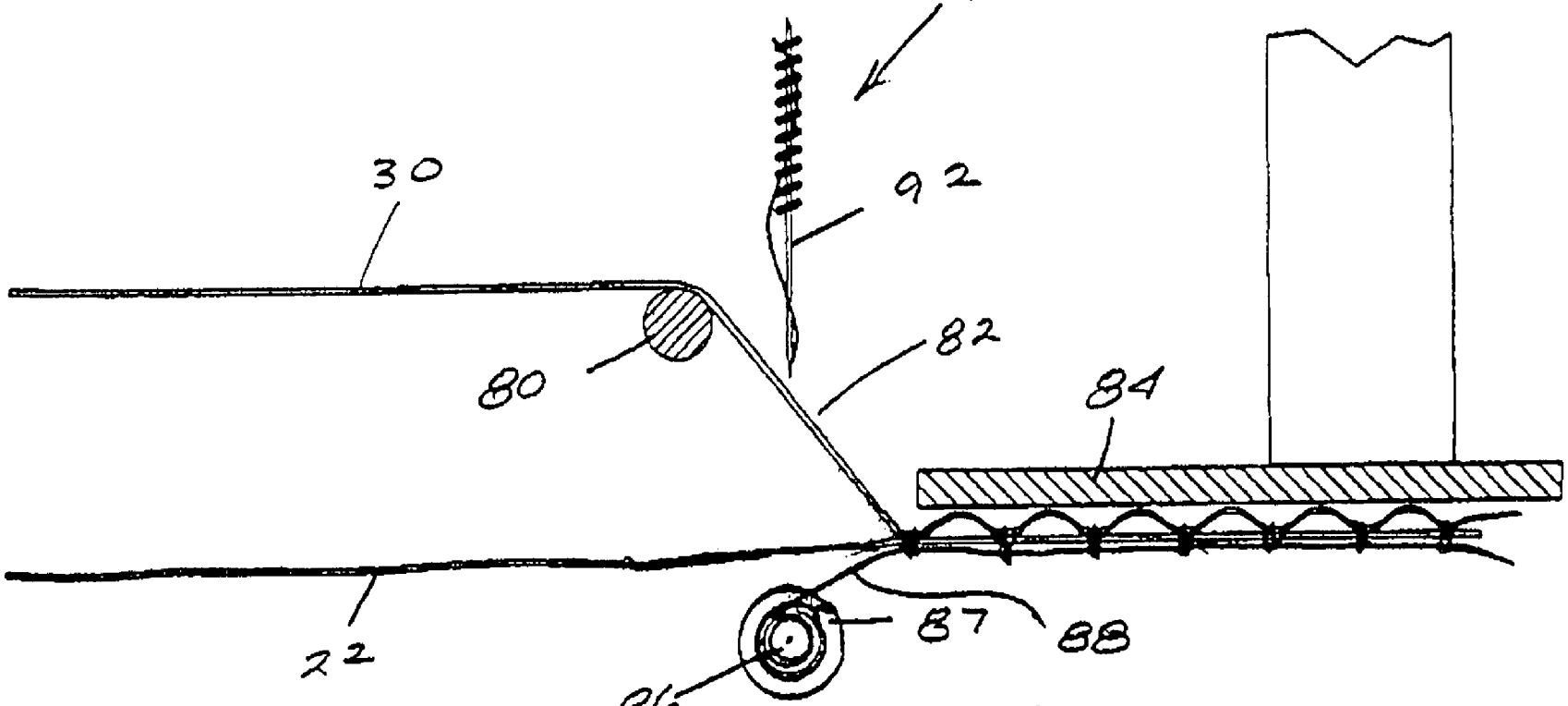
FIG. 11 is a sectional side elevational view of a second embodiment of a sewing machine apparatus of the present invention showing the sewing needle in a raised position.
Figure 12:
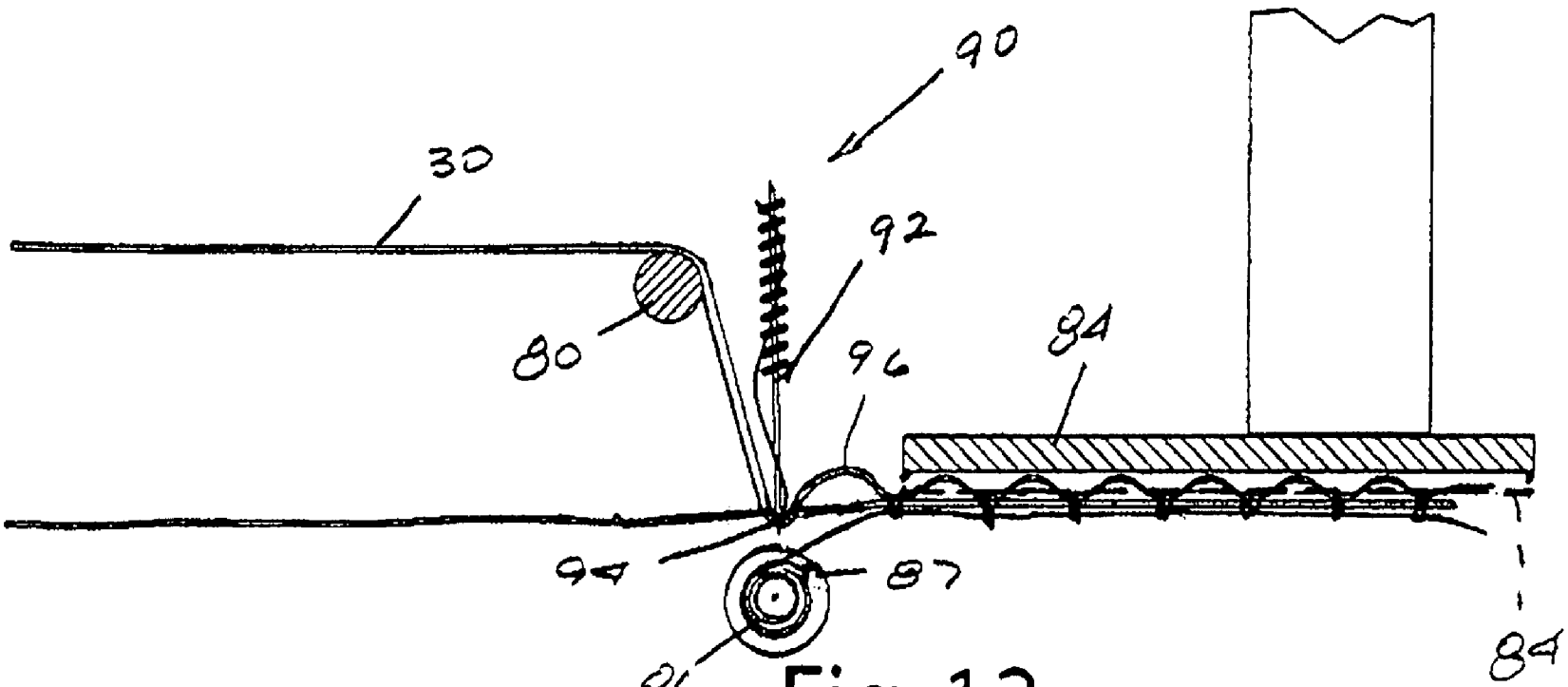
FIG. 12 is a sectional side elevational view as in FIG. 1, showing the sewing needle in a lowered position.

Another method for advancing the upper fabric or outer material 28 faster than the lower fabric or material 22, so that the upper fabric becomes wrinkled when sewn to the lower fabric, is shown in FIGS. 11 and 12. In this embodiment, the strips 30 of the upper (outer) material 28 are spaced substantially above the lower fabric or substrate 22 by means of a spacer bar 80, such that a portion 82 of the upper fabric is inclined at a downward angle with respect to the lower fabric immediately upstream of the location where the fabrics are sewn together. A presser foot 84 mounted downstream of the sewing location, and a feed dog or other feed mechanism positioned below the presser foot cause the fabric to be moved through the sewing location. A bobbin 86 and shuttle hook 87 cause a lower thread 88 to be inserted in a loop in the upper thread to form a conventional lock stitch.

Sewing head 90 in this embodiment operates to produce a wrinkled outer surface of the camouflage material as follows. When the needle 92 reciprocates from the position of FIG. 11 to the position of FIG. 12, the needle first engages material 30 at the inclined portion 82 thereof at a position above lower material 22. As the needle is driven downwardly, the needle engages the material at the inclined portion and moves this portion directly downwardly to position 94 shown in FIG. 12 while the presser foot is lowered (as shown in phantom) to hold the material in place. This produces a small loop 96 in the upper fabric, and the sewing operation sews the outer fabric to the substrate with the loop in the fabric, thus producing a deformed or wrinkled portion of the outer fabric.

It is contemplated that other methods for producing a shirred effect in the outer fabric are possible. For example, some wrinkling can be accomplished by increasing the tension of the upper thread conveyed by the needle. An elastic thread under tension can produce the same effect. Such thread tension, however, can produce wrinkles in the substrate material as well, and this is generally not desirable, because such material may feel scratchy on the skin of the user.

The shirring process can also be achieved by small friction rollers located adjacent each needle. These rollers can be driven by a variable speed motor, such that the outer strip of camouflage material is pushed into the needle at a faster pace than the feed rate of the sewing machine. The roller can be knurled in order to provide appropriate frictional engagement with the upper material. The size of the rollers and the speed of the roller can be changed or adjusted to affect the speed of insertion of the outer strip of camouflage material to increase or decrease the wrinkling or shirring effect.

It will be apparent to those skilled in the pertinent arts that other embodiments of shirred leaves in accordance with the invention can be designed. That is, the principles of shirred leaves are not limited to the specific embodiments describes herein. Accordingly, it will be apparent to those skilled in the art that modifications and other variations of the above-described illustrative embodiments of the invention may be effected without departing from the spirit and scope of the novel concepts of the invention.

We claim:

1. A process for producing a three-dimensional camouflage fabric comprising the steps of:

providing a relatively wide web of a substrate material;

providing an outer material comprising a plurality of transversely spaced, elongated strips of relatively narrower fabric, each strip having side edges along a longitudinal axis and an attachment zone between the side edges, the side edges being formed in an irregular pattern; and attaching the strips to the substrate along laterally spaced lines of attachment positioned between the side edges of the strips, the strips being attached to the substrate in a multi-lane attaching machine, such that the strips are attached to the substrate in a longitudinal wrinkled condition, giving the strips a three-dimensional contour;

wherein the strips are fed into the attaching machine faster than the substrate.

2. A process as in claim 1 wherein the substrate is less wrinkled than the strips of camouflage fabric.

3. A process as in claim 2 wherein the substrate is substantially flat and the strips of camouflage material are substantially wrinkled.

4. A process as in claim 1 wherein the strips are fed faster than the substrate by means of a feeding spring that extends downwardly and forwardly at an inclined angle from a front edge of a presser bar, such that the feeding spring resiliently engages the strip as the presser bar is lowered and urges an additional quantity of strip into the attaching machine for each discrete attachment made between the strip and substrate.

5. A process as in claim 4 wherein the attaching machine comprises a multi-head sewing machine, and wherein each discrete attachment made between strip and substrate comprises a stitch.

6. A process as in claim 1 wherein the attaching machine comprises a multi-head sewing machine such that the strips are fed into the sewing machine faster than the substrate by positioning the strips at an elevated position relative to the substrate and feeding the strips into the sewing machine at an inclined angle from the elevated position and feeding the substrate into the sewing machine in a relatively horizontal direction and by inserting a sewing machine needle through the inclined portion of the strip and the substrate in a direction generally perpendicular with the substrate, such that the needle stitches a greater quantity of material from the strip than the substrate between each stitch.

7. A process as in claim 1 wherein at least some of the strips are mounted close enough together that the edges of the strips at least partially overlap and interfere with each other, so as to urge the edges into a non-planar position.

8. A process as in claim 1 wherein the strips have a camouflage pattern thereon.

9. A process as in claim 1 wherein the irregular pattern of the strips' side edges are shaped and arranged to give the edges the appearance of foliage.

10. A process as in claim 1 wherein the side edges of at least some of the strips having edge patterns that are different from adjacent edge patterns of adjacent strips.

11. A process as in claim 1 wherein the attaching machine comprises a multi-head sewing machine, and wherein the strips are simultaneously attached by stitching to the substrate by said multi-head sewing machine.

12. A three-dimensional camouflage fabric produced in accordance with the process of claim 1.

13. Apparatus for producing a three-dimensional camouflage fabric in accordance with the process of claim 1.

14. A process for producing a three-dimensional camouflage fabric comprising the steps of:

providing a relatively wide web of a substrate material;

providing an outer material comprising a plurality of transversely spaced, elongated strips of relatively narrower fabric, each strip having side edges along a longitudinal axis and an attachment zone between the side edges;

forming the strips' side edges with an irregular pattern, including longitudinally-spaced instances of most-outwardly projecting lobes;

defining a width for each strip as the distance between one and another generally longitudinal lines containing the most-outwardly projecting lobes' tips of one and another of the side edges thereof;

locating the attachment zone for each strip at approximately the middle of each's width; and attaching the strips to the substrate along laterally spaced lines of attachment such that the lateral spacing of lines of attachment for an adjacent pair of strips is substantially less than half the sum of each of the pair's widths whereby the lobes of one strip of said pair overlap the lobes of the other strip of said pair and interfere with one another thereby preventing both lobes from being able to lie flat on the substrate as that one or the other cannot do so, and thus be urged into a non-flat position, hence producing a desirable three-dimensional outer contour.

15. A process as in claim 14 wherein the widths of the strips is about five and three-quarters (~14⅔ cm) inches wide fo all and wherein the spacing of lines of attachment for an adjacent pair of strips is about three inches (~7⅔ cm) apart.

16. A three-dimensional camouflage fabric produced in accordance with the process of claim 14.

17. Apparatus for producing a three-dimensional camouflage fabric in accordance with the process of claim 14.

18. A process as in claim 14 wherein the attaching comprises the strips being simultaneously attached by stitching to the substrate by aid of a multi-head sewing machine.

19. A process as in claim 14 wherein the side edges of at least some of the strips having edge patterns that are different from adjacent edge patterns of adjacent strips.

20. A process as in claim 14 wherein the lines of attachment between adjacent strips is sufficient so that at least some of the lobes of the adjacent strips at least partially overlap and interfere with one another, so as to urge one or another of the lobes into a non-flat position.

* * * * *